United States Patent [19]

Ertel

[11] 4,274,174

[45] Jun. 23, 1981

[54] TOOTHBRUSH

[75] Inventor: Ulrike Ertel, Munich, Fed. Rep. of Germany

[73] Assignee: G.R.P. Gesellschaft für Rationelle Psychologie oHG, Fed. Rep. of Germany

[21] Appl. No.: 119,016

[22] Filed: Feb. 6, 1980

Related U.S. Application Data

[63] Continuation of Ser. No. 4,921, Jan. 19, 1979, abandoned.

[51] Int. Cl.[3] ..... A46B 9/04; A46B 5/02

[52] U.S. Cl. ..... 15/143 R; 15/167 R; D4/25

[58] Field of Search ..... 15/143 R, 167 R, 167 A; D4/18, 25, 28

[56] References Cited

U.S. PATENT DOCUMENTS

| | | | |
|---|---|---|---|
| D. 142,917 | 11/1945 | Strieby | 15/143 R |
| D. 153,130 | 3/1949 | Fischer | 15/167 R X |
| D. 179,441 | 12/1956 | Clemens | D4/25 |
| 2,241,584 | 5/1941 | Cohen | D4/25 X |
| 2,244,615 | 6/1941 | Garcin | D4/25 X |
| 2,414,775 | 1/1947 | Stavely | 15/167 R |
| 2,651,068 | 9/1953 | Seko | 15/167 R X |
| 2,679,657 | 6/1954 | Krueger | D4/25 X |
| 2,934,776 | 5/1960 | Clemens | 15/167 R |
| 3,917,420 | 11/1975 | Watson | 15/167 R |

*Primary Examiner*—Peter Feldman

*Attorney, Agent, or Firm*—Cushman, Darby & Cushman

[57] ABSTRACT

A toothbrush having a conically tapering stem-like grip with an essentially circular cross-section, whereby the bristle carrier, which is rounded on its back, extends toward the center axis at an angle between about 25° to about 35°. In the bend region the grip tapers conically to form a rear-side depression. A short bristle zone is disposed in the front portion of the bristle carrier and is directed toward the center axis of the grip.

9 Claims, 6 Drawing Figures

TOOTHBRUSH

This is a continuation of application Ser. No. 4,921 filed Jan. 19, 1979 (now abandoned).

The invention relates to a toothbrush having a stem-like grip and a front portion as bristle carrier adjoining said grip.

Apart from the cosmetic function, the object of dental care is to preserve the teeth for as long as possible in a healthy state. The essential steps adopted to achieve this object reside in the mechanical and chemical cleaning of the teeth and the spaces between the teeth, firstly to counteract prophylactically tooth and gum complaints and secondly to remove or counteract bad breath. For this purpose, an essential mechanical aid is the toothbrush in conjunction with the toothpaste.

Although the great majority of toothbrush users do not assign any importance to the different forms and design of toothbrushes in dental care, it is known that for example brushing too firmly and rubbing with very hard bristles can injure the gums and damage the dental enamel. To achieve the objective of dental care, the removal of the film over the teeth and food residues from the spaces between the teeth, the correct cleaning technique, regular cleaning and adequate cleaning time are required rather than strong mechanical forces. It follows from this that for optimum dental care the toothbrush must have certain properties, firstly to minimise the disadvantageous mechanical forces as far as possible and secondly to permit a relatively long cleaning time. Tests have shown that the toothbrushes hitherto known do not permit optimum movement cycles and consequently have effects which tend to reduce the cleaning time.

The toothbrushes hitherto known and made substantially rectilinear require an arm and hand posture which in the great majority of users due to muscle tensioning in the neck and arm region leads to an involuntary shortening of the cleaning time. Practical observations show that usually in dental care the toothbrush is guided with the elbow raised to a greater or lesser degree, the up and down or to and fro cleaning movement coming from the upper arm and forearm and leading in conjunction with the force transmission thus necessary to the toothbrush to an excessively firm gripping of the toothbrush. Due to the continuously raised elbow during cleaning pronounced posture tensions arise as well as rapid tiring of the shoulder and arm muscles. Excessive muscle tensions necessarily lead to hasty cramped and inaccurate cleaning movements, exaggerated application pressure and a shortening of the cleaning time.

Because of the anatomical situation movement cycles can only be optimized if the tools used for the treatment have an optimum ergonometric design. This is not true of known toothbrushes. Thus, with regard to dental care with adequate cleaning time, accurate guiding of the movement cycles and avoidance of excessive pressure it is desirable to minimise the forces which must be exerted by the muscles so that the cleaning movements are still carried out in a controlled, uniform manner without excessive tiring even after an optimum cleaning time of about 90 seconds.

The problem underlying the invention is thus to provide a toothbrush which due to its ergonometric design and shape contributes to facilitating the movements during dental care and to making an accurate handling possible in order to reduce the movement forces and the work involved in holding the brush and to increase the cleaning time with a controlled application pressure.

This problem is solved according to the invention by the combination of the following features:

(a) the stem-like grip extends conically rearwardly and has a preferably substantially circular cross-section;

(b) the bristle carrier rounded on its back extends at an angle between 25° to about 35° to the centre axis of the grip;

(c) in the bend region the grip tapers conically in the direction towards the bristle carrier to form a slight rear-side depression;

(d) the bristle zone is disposed in the front portion of the bristle carrier directed towards the centre axis of the grip over a region of less than half the length of the bristle carrier.

With a toothbrush design according to the invention the advantage is achieved that the movement cycles take place with the minimum force expenditure. The combination of the features according to the invention also allows the cleaning operation to be carried out with a relaxed posture with freely hanging upper arm, the cleaning movement originating only from the wrist and the toothbrush being guided deliberately only by thumb and index finger. Since this handling requires less holding force and minimises the muscular force employed for the movement, muscular cramp is avoided and this automatically leads to an increase in the cleaning time.

In order firstly to make the guiding between thumb and index finger still more reliable and secondly to adapt the toothbrush to different hand sizes, a grip depression known per se is provided in the transition region between the grip and bristle carrier and the grip depression extends over the entire bend region into the bristle carrier. This results in various possible hand grips. The grip may be held very individually.

A further development particularly expedient for gripping and holding the grip of the toothbrush is achieved in that the grip with a length of about 120 mm to 140 mm has at its thickest region a diameter of about 12 mm and at its rear end a diameter of less than 6 mm, preferably 3 mm.

The circular form of the grip provides a very uniform pressure distribution on the grip and thus facilitates the force transmission from the hand to the grip.

However, according to a further development the grip is made slightly elliptical in cross-section, thus enabling the guiding accuracy to be improved for certain applications.

For exact guiding and minimum force expenditure with relatively relaxed muscles it is particularly advantageous for the angle between bristle carrier and centre axis of the grip to be about 30°.

To adapt the toothbrush to different hand sizes the grip depression extends about 20 mm into the grip and about 25 mm into the bristle carrier.

It is particularly advantageous for handling the toothbrush and especially for very accurately guided rolling movement for the bristle zone, with a length of about 70 to 80 mm of the bristle carrier, to extend over a distance of about 20 to 30 mm at the front end of the bristle carrier. The surface receiving the bristles may be planar or alternatively trough-shaped. The trough-shape form is particularly advantageous because with a flatly cut bristle zone the bristles of the zone in the centre area are somewhat longer than the bristles in the edge region. As a result the bristles in the centre region of the zone become somewhat softer as is desired in order to reduce wrong mechanical stresses on the teeth and improve the cleaning operation.

A reduction of the mechanical forces on the teeth and the gums can also be achieved by making the individual bristle groups in the bristle zone spherical at the upper ends.

The advantages and features of the invention will be apparent from the following description of an example of embodiment in conjunction with the claims and drawings, wherein:

Figure 1:
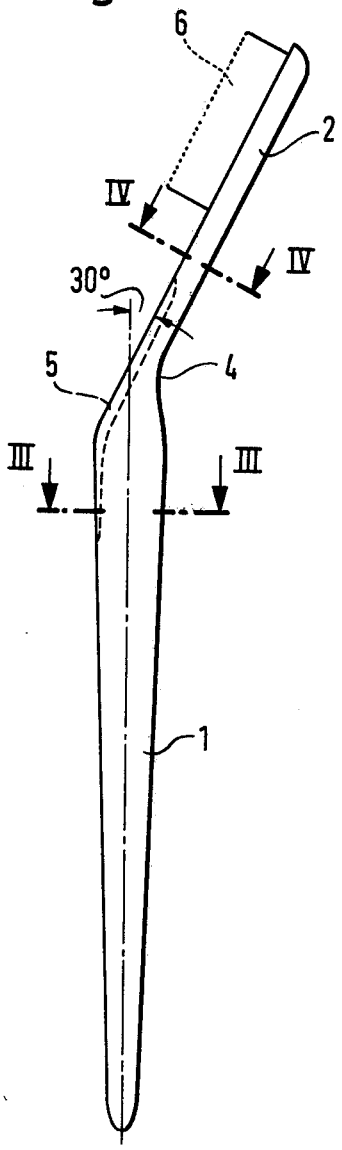
FIG. 1 shows a toothbrush according to the invention in side elevation.
Figure 2:
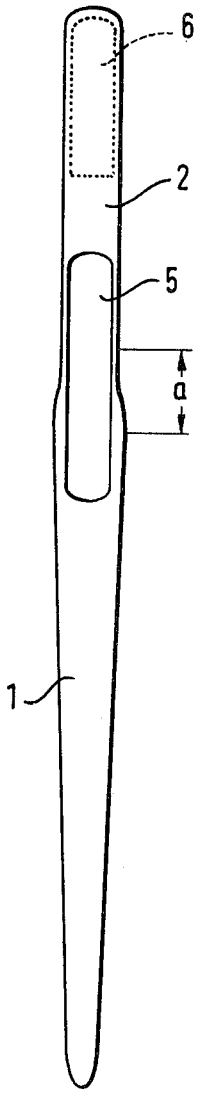
FIG. 2 shows the toothbrush according to FIG. 1 in plan view.
Figure 5:
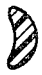
FIG. 5 is a section through a further development (i.e. a second embodiment) of the bristle carrier with a trough-shape surface receiving the bristles, this section being a section equivalent to FIG. 4, but of the second embodiment.
Figure 4:
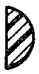
FIG. 4 is a section along the line IV—IV of FIG. 1.
Figure 3:
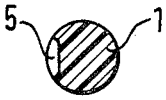
FIG. 3 is a section along the line III—III of FIG. 1.

In FIGS. 1 and 2 the toothbrush according to the invention is shown in side elevation and plan view. The toothbrush consists of a stem-like grip 1 having a circular cross-section which at its thickest region has a diameter of about 12 mm and tapers conically to the rear end, the diameter in front of the rounded rear end being about 5 mm. Extending from this stem-like grip 1 is a bristle carrier 2 at an angle of about 30° to the centre axis of the grip 1. In the bend region a the grip tapers also in the direction towards the bristle carrier 2 so that a depression 4 is formed on the back of the toothbrush in the transition region to the bristle carrier 2. On the front of the bend region a grip depression 5 extends from the grip over the entire bend region into the bristle carrier 2. The bristle carrier 2 itself is made elongated and flat and has a planar surface receiving the bristle zone 6. The bristle zone covers only the front portion of the carrier over a distance which is less than half the length of the carrier. The back of the carrier is rounded as apparent from FIG. 4. In a further development of the bristle carrier according to FIG. 5 the surface receiving the bristle zone is trough-shaped and as a result the bristles in the centre area of the bristle zone are somewhat longer than the edge bristles.

In a preferred embodiment of the toothbrush the grip 1 has a length of about 120 mm and the bristle carrier has a length of about 75 mm. The bristle zone 6 extends over a length of about 20–30 mm, the bristle zone having a height of about 8 to 9 mm in order to reduce the cleaning resistance. The thickness of the bristle carrier is about 4.5 mm and the width of the planar surface is about 10 mm. As already mentioned, the grip 1 has a maximum diameter of about 12 mm and tapers up to its rear end to a diameter of about 5 mm. The grip trough extends over the bend region about 20 mm into the grip 1 and about 20 mm into the bristle carrier 2.

The bristle zone 6 is preferably cut planar and the cut edge of the individual bristles is rounded as far as possible to prevent danger of injury. As particularly advantageous as regards reducing the danger of injury is a bristle zone whose individual bristle groups are spherically rounded at their upper ends. This form is not shown in the drawings.

Figure 6:
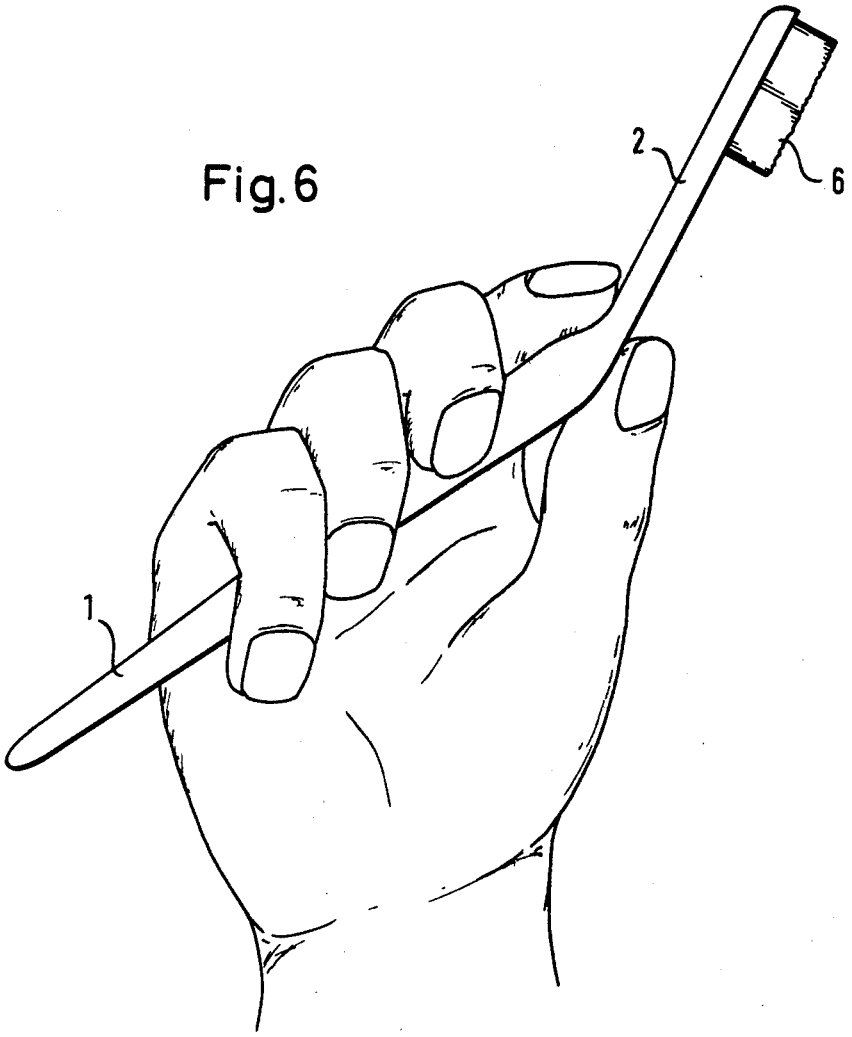
FIG. 6 is a perspective view of a toothbrush according to the invention held by hand.

FIG. 6 illustrates how the toothbrush is held in use. The view of the hand shown is one as seen by the user looking at his hand in front of him holding the toothbrush correctly. The toothbrush is brought out of the position illustrated by turning the hand through 180° into the position from which the cleaning of the teeth is effected. In the cleaning movement the bristle zone is moved substantially from the top to the bottom. For brushing the teeth from front to back and vice versa the toothbrush is guided as a whole with the hand by movement from the shoulder joint with the upper arm hanging freely.

Such a handling of the toothbrush gives optimum movement cycles with minimum force expenditure both as regards the movement of the toothbrush and for holding the toothbrush. The method of holding the toothbrush described automatically promotes the up and down movement of the bristle zone, i.e. in the longitudinal direction of the tooth gaps, which is regarded as particularly advantageous for the cleaning operation. Due to the cleaning movement with the upper arm hanging freely cramp of the hand due to the holding effort and excessive muscular tensioning in the shoulder region and in the elbow and upper arm are avoided, greatly reducing the fatigue and leading automatically to an increase in the average time of cleaning. Due to the specific shape of the toothbrush and the resulting handling thereof excessive scraping of the teeth is hardly possible because the application pressure is reduced. It has been determined with the aid of tests that when changing from conventional toothbrushes to the toothbrush according to the invention test persons automatically increased the average cleaning time from about 22 to 26 seconds with conventional brushes to usually more than twice this time with the brush according to the invention.

In an embodiment of the toothbrushes not shown for small hands the tapering extending from the maximum grip diameter towards the bristle carrier also extends into the bristle carrier and effects a constriction of the latter between the bend region and the bristle zone. This constriction leads essentially to a reduction of the width of the bristle carrier in this region. The reduction of the width of the bristle carrier may also be combined with a shortening of the portion of the grip depression extending into the carrier.

The essence of the idea underlying the invention may also be realised in an electric toothbrush by replacing the stem-like grip by the grip of the electric toothbrush in which the drive motor is accommodated. The drive motor performs the cleaning movement so that the cleaning operation can be carried out not only with a relaxed posture and freely hanging upper arm but also with a substantially stationary hand. It is possible either to provide a toothbrush attachment with a bend of about 25°–35° according to the invention which may be fitted onto a rectilinear drive pin or to use a conventional rectilinear toothbrush attachment which may be fitted onto a drive pin which itself is bent at an angle of about 25°–35° to the longitudinal direction of the grip.

What is claimed is:

1. A toothbrush body having a stem-like grip to be gripped in the hand of a human operator, this grip adjoining a bristle carrier in an intervening bend region so that the bristle carrier extends forwards, and the grip extends rearwards from this bend region, said bristle carrier having a front side and a back side, said toothbrush body comprising:

(a) said grip outside of said bend region extending conically rearwardly, decreasing in transverse cross-sectional area from said bend region towards a rear tip;

(b) said grip being of such length as to rearwardly extend to beyond the gripping hand of the operator when the operator's hand grips said grip, with the operator's opposed thumb and forefinger being on or forwardly of said bend region;

(c) said bristol carrier being elongated, straight and rounded on a back side thereof, said bristle carrier extending forwardly from said bend region at an angle of about 25° to about 35° to the longitudinal axis of said grip;

(d) said bristle carrier having a length of about 70 mm to about 80 mm and a substantially constant width along a longitudinally extending axis;

(e) said grip within said bend region extending conically forwardly, decreasing in transverse cross-sectional area as it extends axially towards said bristle carrier within said bend region, thereby forming a depression on the back side of said toothbrush body in said bend region;

(f) surface means defining a flat, longitudinally elongated continuous grip depression of substantially constant width in the front side of said toothbrush body extending longitudinally over the entire bend region and both rearwardly into said stem-like grip rearwardly of said bend region and forwardly into said bristle carrier along at least a fourth the length of said bristle carrier outside said bend region; and (g) a bristle zone defined on the front side of said bristle carrier and extending longitudinally thereon for substantially less than half the length of said bristle carrier from adjacent the forward end of said bristle carrier with said bristle carrier front side being substantially planar in said bristle zone.

2. The toothbrush body of claim 1, wherein:

the length-to-diameter ratio of said stem-like grip adjacent the bend region is about 1:10 to 1:12 and adjacent the rear tip is about 1:20 to about 1:48.

3. The toothbrush body of claim 2, wherein:

said stem-like grip has a length of about 120 mm to about 140 mm, the greatest diameter thereof in the bend region being about 12 mm and the rear tip diameter thereof being less than 6 mm.

4. The toothbrush body of claim 3, wherein said stem-like grip rear tip has a diameter of about 3 mm.

5. The toothbrush body of claim 1, wherein:

said bristle carrier extends at an angle of about 30° to the longitudinal axis of said grip.

6. The toothbrush body of claim 1, wherein:

said grip depression extends about 20 mm longitudinally into the grip and about 25 mm longitudinally into the bristle carrier.

7. The toothbrush body of claim 1, wherein:

said bristle zone has a length of about 20 mm to about 30 mm.

8. The toothbrush body of any one of claims 1–7 wherein:

said grip is of substantially circular transverse cross-sectional shape, but for said grip depression, at substantially all possible transverse cross-sections thereof.

9. The toothbrush body of any one of claims 1–7 wherein:

said grip is of substantially elliptical transverse cross-sectional shape, but for said grip depression, at substantially all possible transverse cross-sections thereof.

* * * * *